United States Patent [19]

Olson, Jr.

[11] 4,084,820

[45] Apr. 18, 1978

[54] JET LAUNCH TOY

[76] Inventor: Knute E. Olson, Jr., 190 Plain St., Brockton, Mass. 02402

[21] Appl. No.: 664,485

[22] Filed: Mar. 8, 1976

Related U.S. Application Data

[63] Continuation-in-part of Ser. No. 586,956, Jun. 6, 1975, abandoned.

[51] Int. Cl.[2] ..... A63B 65/12

[52] U.S. Cl. ..... 273/96 R; 124/56; 46/44; 46/74 R; 46/74 A

[58] Field of Search ..... 46/44, 74; 273/96 R, 273/96 B; 124/56

[56] References Cited

U.S. PATENT DOCUMENTS

| | | | |
|---|---|---|---|
| 1,189,921 | 7/1916 | Cory | 273/96 R |
| 3,087,278 | 4/1963 | Waggle, Jr. | 46/44 |

OTHER PUBLICATIONS

Playthings Publication, Nov. 1961, p. 76.

*Primary Examiner*—Louis G. Mancene
*Assistant Examiner*—Robert F. Cutting

[57] ABSTRACT

A jet launch toy which consists of a jet launching tube and missle together with a skilled users hands for entertainment and an extended version comprising the jet launching tube, together with a funnel shaped catching arrangement, together with a backboard for diverting the launched missle (in this case, table tennis ball) to another player who catches same for return launching or bats it back with the back of the launcher.

1 Claim, 5 Drawing Figures

JET LAUNCH TOY

This application is a continuation-in-part of pending patent Application Serial No. 586,956 now abandoned, for popping Rockets, filed on June 6, 1975.

This invention relates to toys and more particularly to a toy wherein the user develops a skill in utilizing coordination of this hand and a cupping arrangement of them, in such a way that the can develop a jet of compressed air which launches a missile from the end of the tube. The device relates then to a game of skill as well as a toy.

Jet launching toys have been suggested in the prior art, however, they have all included compression devices which develop pressure confined in a tube and launched a plug similar to a cork or missile similar to the present invention. However, the added diaphram was discovered as unnecessary for the surplus air beyond the pop, the launch is wasted. Moreover, the skilled user with practice, can launch a missile as far every time. This toy then requires and develops skills.

In the present invention all unnecessary compression chamber or additional paraphernalla have been eliminated. One can hold the launching tube in one hand, cup the other hand and strike the bottom of the hand holding the tube and develop considerable compressed air depending as was stated earlier, upon the skill of the user. It appears that the fleshy part of one's hand and the manner in which one cups his hand develops a compression chamber for developing the compressed air for launching the missile.

The present invention has been developed or extended still further to a game with two or more players. A missile such as a ping pong ball is propelled back and forth to one another in a game of catch. The receiver has the option of batting the ball back or catching it and jet launch it back.

A funnel shaped device with a jet launching tube held in one hand as in the jet launcher spoken of earlier has been developed, together with an optional backboard which is mounted within the funnel for defecting the projectile in a normal manner. The missile emerges from the funnel shaped end and toward a receiving player. The player can with the back of his jet launching toy strike the ball back or can catch it, and jet launch it back again. A necessary skill in the game is obviously the distance one can hurl the projectile, while utilizing the launcher. Accordingly, when two players get further and further apart one of the players will be unable to project the projectile of the above missile. It was also discovered that the launching tube can be partly blocked off and a ring of small openings extending around the outside perimeter of the launching tube in such a way that the ball is projected with uniform force over a wider circumferance.

Therefore an object of missile present invention is to provide a launching tube and missle toy requiring skill of the user in launching said missile.

Another object of the present invention is to provide a launching tube having a funnel shaped catching end, together with a diverting backboard for diverting projectiles such as table tennis balls.

Another object of the present invention is to provide an extremely simple launching tube for missile toys.

Another object of the present invention is to provide a game comprising launching tubes and funnel shaped catching devices together with a backboard for diverting projectiles toward a receiving player, and an optional batting end for returning balls.

Further objects, features and advantages of the present invention will be better understood from the following detailed specification, especially when read in conjunction with the attached drawings of which:

Figure 1:
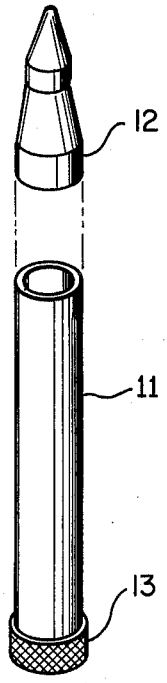
FIG. 1 is a launching tube, and missile.

Referring to FIG. 1 we see a jet tube 11 and a missile 12. Tube 11 is completely hollow and could be fabricated of plastic, wood or even in some forms of paper. The end of tube 11 has a rubber tip 13, this protects the users hand so that he does not injure it as he strikes the bottom of the launching tube. The missile 12 interfits very neatly in the launching tube 11, and when the user's hand strikes the bottom of the tube the air in the tub's column compresses until such time as the pressure exceeds the resistance of the missile's end, and the tube releases the missile and the missile pops out and is launched.

Figure 2:
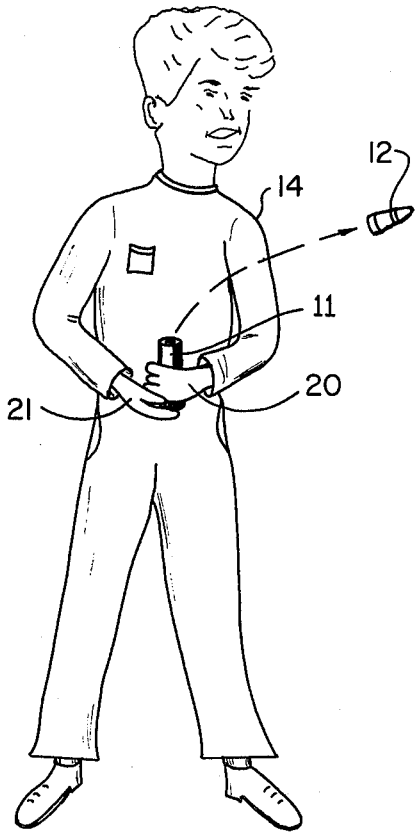
FIG. 2 is a child launching a missile.

Referring now to FIG. 2 we see a boy 14 with his hand 20 and 21. He holds the jet launcher 11 in one hand and the fleshy part of the hand projects over the edge of the launcher tube, and he takes the left hand, or the right hand, depending upon how he holds it, and swings the right hand cupping his hand banging the bottom, forcing the projectile 12 out. With skill the maximum amount of force that can be developed is dependant upon the friction of the missile held within the unit, and not upon the cupping of the hands beyond a certain critical point, which is easily developed with skill.

Figure 3:
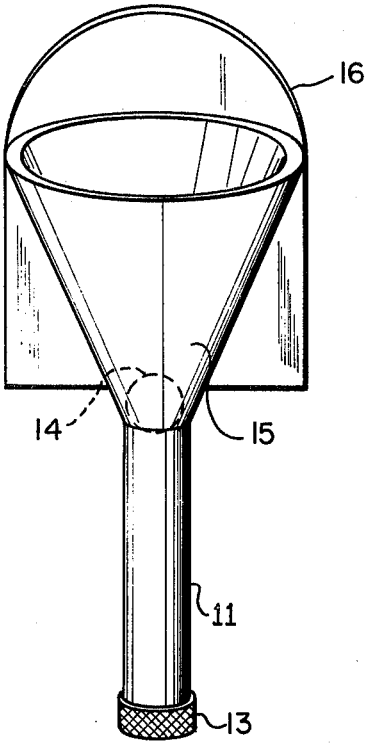
FIG. 3 is a launching device with a funnel shaped catching end and diverting back board.

Referring now to FIG. 3 we see a jet launching tube 11, together with a funnel shaped end 15, and at the bottom of the funnel shape we have a table tennis ball or other type ball 14. The ball or missile is launched in the same manner as the missile in the other launching tube shown in FIG. 1 and 2. We also have a backboard which can tipped slightly forward in such a way that the ball goes straight up and strikes the tilted backboard firing the ball forward towards an opponent. The backboard can also be straight and then the handle or launching tube 11 would have to be tilted forward to point the ball toward the opponent and struck directed toward him. It is to be noted that the funnel is forward a slight bit and at the backboard is at the outer perimeter. That is, that the ball will have the entire funnel shape to roll around in when it is caught.

Figure 3A:
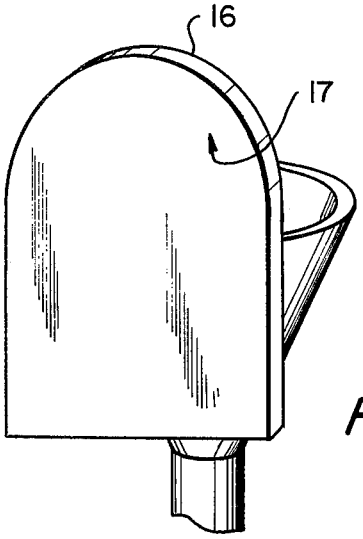
FIG. 3A shows a reverse side of FIG. 3.

The procedure is as follows: The ball is placed in the launching tube, the handle or launching tube is held in one hand, and the compression struck such that the ball is fired toward the opponent. The opponent then catches the ball and then can return it back to the other opponent or player. An other arrangement is shown in FIG. 3A which is the back side of backboard 16. Here a surface is placed on it which is similar the surface on a ping pong paddle. The player then has the option of striking the ball back to his opponent, or catching it in the funnel end, and launching it back as we have already described.

Figure 4:
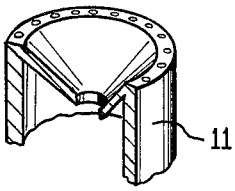
FIG. 4 is a partially blocked collumnating end for a launcher.

Referring now to FIG. 4 we see a section of the launching tube at the top. This section of the launching tube has a cone shape insert having holes about the perimeter, which is also sloping. The ball fits into this unit and the air stream is forced about the perimeter forcing a uniform jet to propell the ball in the desired direction. The arrangement of the receiving end here can be made of more closely fitting materials, which would receive the projectile or missile with a tighter frictional grip, then the user can push the ball into this ring, and the force of his projection will be related to the amount of friction it is held back with, once launched the ball will have a greater force on it as it is released.

It is clearly seen that the concept compressing air and launching a missile is now fully understood, and that the frictional grip on the missile is the controlling factor in the force projecting missiles. The present invention here maximizes this force and requires skill in the user, yet safely such that they can utilize their hands and exploit them in launching a missile. Moreover, a game can be developed which utilizes table tennis balls, and the game of catch between individual players who can bat the ball back, or catch it and launch it again, with appropriate rules providing an interesting game.

Although I have described my invention with reference to specific apparatus, I do not wish to be limited thereby. I only wish to be limited by the appended claims of which:

I claim:

1. A jet launching toy comprising in combination, a hollow jet launching tube having a ball shaped missile receiving end and a hand striking end to receive compressed air, a tight ball shaped missile for inserting in one end of said tube whereby a user can strike the hand striking end with his cupped hand to launch said missile, a rubber end ring at said hand striking end to protect the users hand, a funnel shaped end at said missile launching end to catch returned missiles, an end board attached to said funnel for batting back missiles, a forward leaning board to divert launched missiles, and collumnating jet ring at said launching end.

* * * * *